United States Patent [19]

Davis

[11] 4,452,363

[45] Jun. 5, 1984

[54] TAMPER-RESISTANT AND CHILD-RESISTANT CONTAINER AND CAP ASSEMBLY

[75] Inventor: Eugene E. Davis, Ilford, England

[73] Assignee: Johnsen & Jorgenson (Plastics) Ltd., London, England

[21] Appl. No.: 507,135

[22] Filed: Jun. 23, 1983

[30] Foreign Application Priority Data

Sep. 12, 1982 [GB] United Kingdom ..... 8235092

[51] Int. Cl.[3] ..... B65D 55/02

[52] U.S. Cl. ..... 215/216; 215/258

[58] Field of Search ..... 215/216, 258, 252, 253

[56] References Cited

U.S. PATENT DOCUMENTS 3,984,021 10/1976 Uhlig ..... 215/216

4,380,299 4/1983 Llera ..... 215/258

*Primary Examiner*—George T. Hall

*Attorney, Agent, or Firm*—Barnes & Thornburg

[57] ABSTRACT

This invention provides a tamper-resistant and child-resistant container and cap assembly in which a container body with a substantially cylindrical neck including an externally screw threaded portion near to the top and a plurality of lugs at the bottom, a cap with a cap body which tapers internally outwardly from an internally screw-threaded part near to the top and which has a corresponding number of depending webs near to the bottom for engagement with the lugs of the container body in the manner of a ratchet and pawl mechanism and a tamper-resistant band provided below the cap body and connected thereto by frangible tongues, the band being shaped to engage with the container body so that when the cap is unscrewed the cap body rises but the band is held down and the frangible tongues are broken.

9 Claims, 5 Drawing Figures

Fig.1.
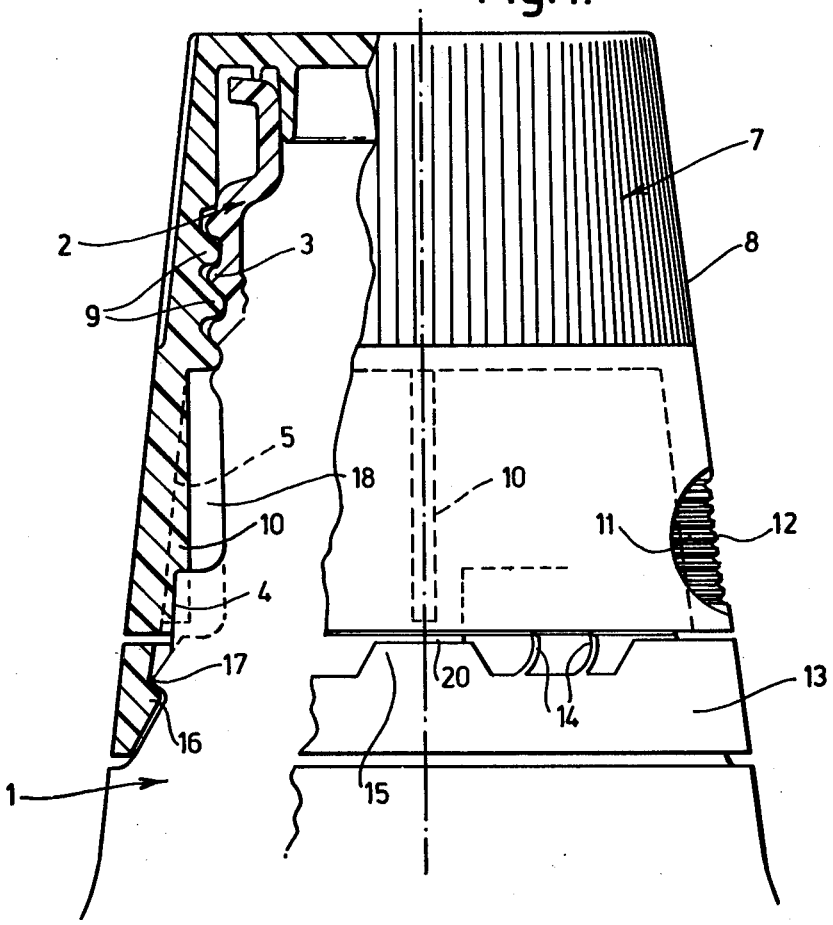
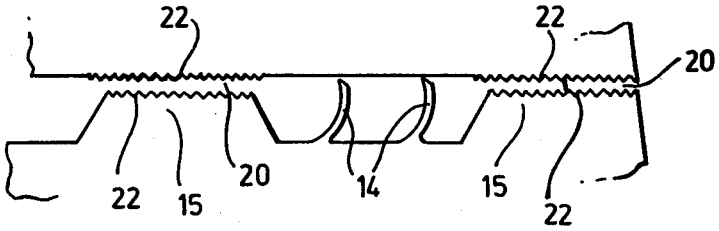
Fig.5.

TAMPER-RESISTANT AND CHILD-RESISTANT CONTAINER AND CAP ASSEMBLY

This invention is concerned with the provision of a tamper-resistant and child resistant cap and container assembly. The invention also includes a cap for use with a container and a container for use with a cap.

According to the present invention we provide a tamper-resistant and child-resistant container and cap assembly comprising a container body with a substantially cylindrical neck including an externally screw threaded portion near to the top and a plurality of lugs at the bottom, a cap with a cap body which tapers internally outwardly from an internally screw threaded part near to the top and which has a corresponding number of depending webs near to the bottom for engagement with the lugs of the container body in the manner of a ratchet and pawl mechanism and a tamper-resistant band provided below the cap body and connected thereto by frangible tongues, the band being shaped to engage with the container body so that when the cap is unscrewed the cap body rises but the band is held down and the frangible tongues are broken.

The invention also includes a tamper-resistant and child-resistant container and closure assembly wherein the container has a body with a mouth and an external screw-threaded portion around the mouth, and wherein the cap has a cap body having an internal screw threaded portion for engagement with the container body and shaped so that the inner surface of the cap tapers outwardly below the screw threaded part towards the bottom of the cap whereby when the cap is seated on portion for engagement with the container body and shaped so that the inner surface of the cap tapers outwardly below the screw threaded part towards the bottom of the cap whereby when the cap is seated on the container body there is a space between the inner surface of the bottom of the cap body and the outer surface of the container body and interengaging webs on the cap and lugs on the container body for engagement with one another when the cap is screwed on to the container body to prevent removal of the cap until the cap or the container is squeezed at oppositely disposed positions away from the points of engagement of the webs and lugs to deform the cap body or the container body so that the webs are disengaged from the lugs to permit unscrewing of the cap body, a tamper-resistant-band being provided below the cap body and connected thereto by frangible tongues and the band being shaped to engage with the container body so that when the cap is unscrewed the cap body rises but the band is held down and the frangible tongues are broken.

Figure 2:
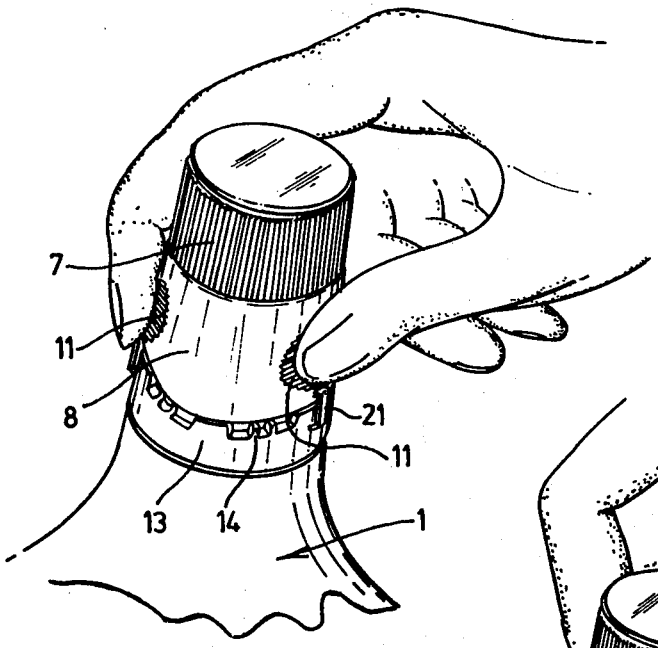
Figure 3:
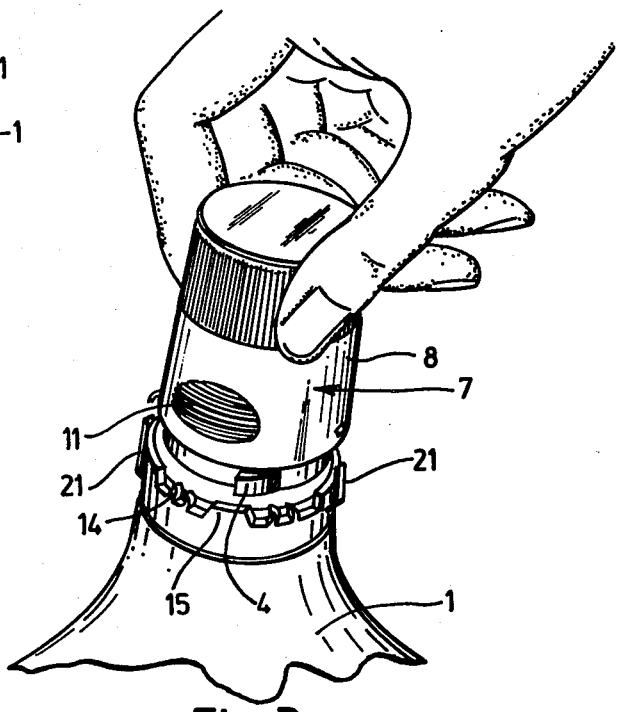
Figure 4:
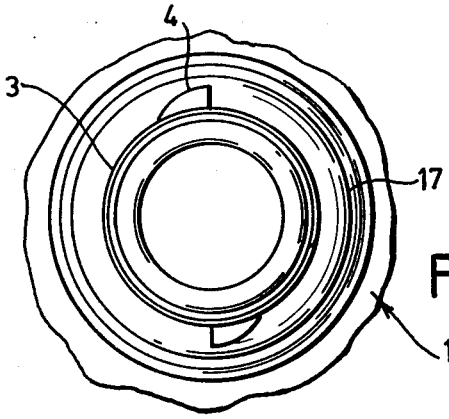

In order that the invention may be more clearly understood reference is now directed to the accompanying drawings given by way of example, in which FIG. 1 drawn to an enlarged scale as compared with the other figures, is a sectional side elevation of an assembly according to the invention, the right hand side of the drawing being in elevation and the left hand side being a section on the line A—A, FIG. 2 is a pictorial view showing the cap in position, FIG. 3 is a pictorial view showing the cap partially removed, and FIG. 4 is a plan view of the container with the cap off.

FIG. 5 is a detail view showing teeth on the body of the cap and on the tamper-resistant band.

The assembly illustrated comprises a container body 1 with a substantially cylindrical neck 2 with a screw thread 3 near to the top and lugs 4 at the bottom forming ratchet teeth. In plan the lugs 4 have an inclined surface at one side and a sharp surface at the other side to form the ratchet teeth. A cap 7 has an inclined outer surface 8 and a screw threaded part 9 near to the inner top part for engagement with the screw thread 3 on the container neck 2. The inner surface of the cap 7 then tapers outwardly at 5 with inwardly projecting webs 10 for engagement with the lugs 4. The outer surface of the cap 7 has squeeze positions 11 with serrations 12. The positions 11 are diametrically opposed and only one is shown in FIG. 1 of the drawings because the left hand side is broken away. Preferably there are two diametrically opposed lugs 4, two diametrically opposed webs 10 and two diametrically opposed positions 11 and the squeeze positions 11 are sufficiently displaced from the webs 10, preferably by 90° to ensure that when pressure is applied to the positions 11 the webs are disengaged from the lugs 4.

The cap 7 also has a tamper-resistant band 13 at the bottom connected to the main part of the cap 7 by frangible tongues 14, the top edge of the band 13 also has castellations 15 and the inner surface of the band 13 has an internal projection 16 for engagement below an external projection 17 near to the bottom of the neck of the container. The fact that the inner surface of the cap tapers outwardly at 5 while the corresponding outer surface of the container in substantially vertical means that gaps 18 appear between the cap and the container.

In operation when cap 7 is applied to the container body and is screwed into position the webs 10 on the inside of the cap 7 ride up along the inclined surfaces of the lugs 4 on the container neck and then seat beyond the sharp surfaces so that the lugs 4 and the webs 10 serve in each case as a ratchet and pawl to prevent unscrewing of the cap. In addition the projection 16 rides down an inclined surface 19 forming the projection 17 into the position shown in the drawings. While this movement is taking place the main part of the cap 7 tends to move downwardly towards the band 13 so that the gap 20 tends to close and the frictional engagement of the top of the castellations 15 with the bottom edge of the main part of the cap helps the band 13 to move round with the rest of the cap. If necessary the frictional engagement may be enhanced by the provision of teeth or serrations 22 on the meeting edges. The bow shape of the tongues 14 allows the tongues to deform as they adjust their shape during the movement.

In order to disengage the cap 7 from the container 1 it is necessary to squeeze the cap 7 at the squeeze positions 11 to deform the cap 7 into an elliptical plan form to disengage the webs 10 from the lugs 4 after which the cap 7 can be unscrewed from the container. The tapered side walls of the cap 7 make enough space between the cap and the neck of the container to enable the squeeze unlocking to be effective. At the same time unscrewing of the cap 7 causes the main part of the cap to rise relatively to the container body but the band 13 is restrained by the engagement of the projection 16 below the projection 17. This means that the main part of the cap 7 will rise but the band 13 will tend to remain in the same position so that the gap 20 will open and there will be no frictional or other force tending to cause the band to turn. The tongues 14 will therefore break and the band 13 will be left behind.

If the cap 7 be in the position shown in FIG. 2 with the tongues 14 intact then the cap 7 has not been removed from the container since it left the factory. This gives a clear indication that the contents of the container have not been tampered with. On the other hand if the tongues be broken then that indicates that the contents may have been tampered with; this is the tamper-resistant feature. The child-resistant feature is provided by the engagement of the webs 10 with the lugs 4 which makes it impossible to turn the cap 7 to unscrew it unless the user squeezes the cap at the positions 11.

The cap and container are preferably moulded as single units from suitable resilient plastics material and the assembly may be used to contain liquids, powders or solids.

As shown in FIGS. 2 and 3 bridge members 21 may be provided spanning the gap 20 between the body of the cap and the tamper-resistant band. If the bridge members 21 are in tact as shown in FIG. 2 then the cap has not been removed but once the members 21 are broken then the broken members indicate that the container may have been opened. Preferably the tongues 14 have a part of reduced width at the top as shown in FIG. 1.

I claim:

1. A tamper-resistant and child-resistant container and cap assembly comprising a container body with a substantially cylindrical neck including an externally screw threaded portion near to the top and a plurality of lugs at the bottom, a cap with a cap body which tapers internally outwardly from an internally screw-threaded part near to the top and which has a corresponding number of depending webs near to the bottom for engagement with the lugs of the container body in the manner of a ratchet and pawl mechanism and a tamper-resistant band provided below the cap body and connected thereto by frangible tongues, the band being shaped to engage with the container body so that when the cap is unscrewed the cap body rises but the band is held down and the frangible tongues are broken.

2. A tamper-resistant and child-resistant container and cap assembly wherein the container has a body and a mouth and an external screw-threaded portion around the mouth and wherein the cap has a cap body with an internal screw threaded portion for engagement with the container body and shaped so that the inner surface of the cap tapers outwardly below the screw threaded part towards the bottom of the cap whereby when the cap is seated on the container body there is a space between the inner surface of the bottom of the cap body and the outer surface of the container body, and interengaging webs on the cap and lugs on the container body for engagement with one another when the cap is screwed on to the container body to prevent removal of the cap until the cap or the container is squeezed oppositely disposed positions away from the points of engagement of the webs and lugs to deform the cap body or the container body so that the webs are disengaged from the lugs to permit unscrewing of the cap body, a tamper-resistant band being provided below the cap body and connected thereto by frangible tongues and the band being shaped to engage with the container body so that when the cap is unscrewed the cap body rises but the band is held down and the frangible tongues are broken.

3. An assembly according to claim 1 or 2 wherein the lugs in plan have an inclined surface at one side and a sharp surface or shoulder at the other side to form ratchet teeth.

4. An assembly according to claim 1 or 2 wherein the outer surface of the cap has squeeze positions diametrically opposite one another.

5. An assembly according to claim 1 or 2 wherein there a are two diametrically opposed lugs, two diametrically opposed webs and two diametrically opposed squeeze positions which are sufficiently displaced from the webs to ensure that when pressure is applied to the squeeze positions the webs are disengaged from the lugs.

6. An assembly according to claim 1 or 2 wherein the top edge of the tamper-resistant band has castellations between which the frangible tongues are disposed and wherein the inner surface of the band has an internal projection for engagement below an external projection on the neck of the container.

7. An assembly according to claim 1 or 2 wherein the inner surface of the cap tapers outwardly while the corresponding outer surface of the container is substantially vertical so that gaps are provided between the cap and the container.

8. An assembly according to claim 1 or 2 wherein the teeth are provided on the bottom edge of the body of the cap and on the top edge of the tamper-resistant band.

9. An assembly according to claim 1 or 2 wherein bridge members are provided connected at one end to the body of the cap and at the other end to the tamper-resistant band.

* * * * *